United States Patent [19]

Wise

[11] 4,244,512

[45] Jan. 13, 1981

[54] MAILBOX

[76] Inventor: Gerald W. Wise, 210 E. Mill Rd., Evansville, Ind. 47710

[21] Appl. No.: 55,517

[22] Filed: Jul. 9, 1979

[51] Int. Cl.[3] ..... A47G 29/12

[52] U.S. Cl. ..... 232/17; 232/38

[58] Field of Search ..... 232/17, 34, 35, 38; 312/204

[56] References Cited

U.S. PATENT DOCUMENTS

| | | | |
|---|---|---|---|
| 2,442,056 | 5/1948 | Montgomery | 312/204 X |
| 2,448,945 | 9/1948 | Zacharias | 232/38 |
| 3,107,848 | 10/1963 | Penta | 232/17 |
| 3,181,913 | 5/1965 | Guido et al. | 312/204 X |
| 3,275,229 | 9/1966 | Turner | 232/34 |
| 3,498,256 | 3/1970 | Hebal | 232/35 |

*Primary Examiner*—Francis K. Zugel

*Attorney, Agent, or Firm*—Woodard, Weikart, Emhardt & Naughton

[57] ABSTRACT

Having a base defining an inner pair and an outer pair of upperwardly-facing channels, a transparent cover having opposed edges received within the outer pair of channels, and a picture having opposed edges received within the inner pair of channels. The mailbox is mounted to a support in conventional fashion and includes a hinged door.

3 Claims, 4 Drawing Figures

MAILBOX

BACKGROUND OF THE INVENTION

1. Field of the Invention

The present invention relates to the field of mailboxes, and more particularly to see-through mailboxes.

2. Description of the Prior Art

The present invention provides a see-through mailbox which provides for a picture to be held beneath a transparent cover to be viewable from outside the mailbox. Certain mailbox designs in the prior art have included transparent portions to permit the mail within the mailbox to be viewed. For example, a glass or plastic mail box is disclosed in each of U.S. Pat. Nos. 2,370,682, issued to Overmyer on Mar. 6, 1945; 1,959,963, issued to Overmyer on May 22, 1934; and 1,393,944, issued to Chapman on Oct. 18, 1921. In U.S. Pat. No. 2,561,007, issued to Bierig on July 17, 1951, there is disclosed a mailbox which includes a transparent auxiliary receptacle for outgoing mail to be visible.

In U.S. Pat. No. 3,107,848, issued to Penta on Oct. 22, 1963, there is disclosed an encapsulated mailbox. An inner, mail-receiving box of metal or plastic is substantially encased in an outer transparent covering. Holes are provided in the inner mailbox to permit viewing through the outer covering and through these holes to the interior where the mail is kept. A light is also preferably included which is housed within the encapsulating cover and thereby protected from the elements.

SUMMARY OF THE INVENTION

In one aspect of the present invention a mailbox is provided which includes a base and a transparent cover mounted to the base, and additionally means for holding a picture adjacent to the cover and viewable from outside the mailbox. In a preferred embodiment the invention includes a base having two pairs of upwardly-facing channels. Opposite edges of the transparent cover are received in the outer channels, and opposite edges of a picture are received in the inner pair of channels.

It is an object of the present invention to provide a mailbox having a transparent cover and means for holding a picture adjacent the cover to be viewed from the outside.

Another object of the present invention is to provide a see-through mailbox which provides for the ready interchange of pictures viewable therein as with the change of seasons.

Other objects and advantages of the present invention will become apparent from the description of the preferred embodiment which follows.

DESCRIPTION OF THE PREFERRED EMBODIMENT

Figure 1:
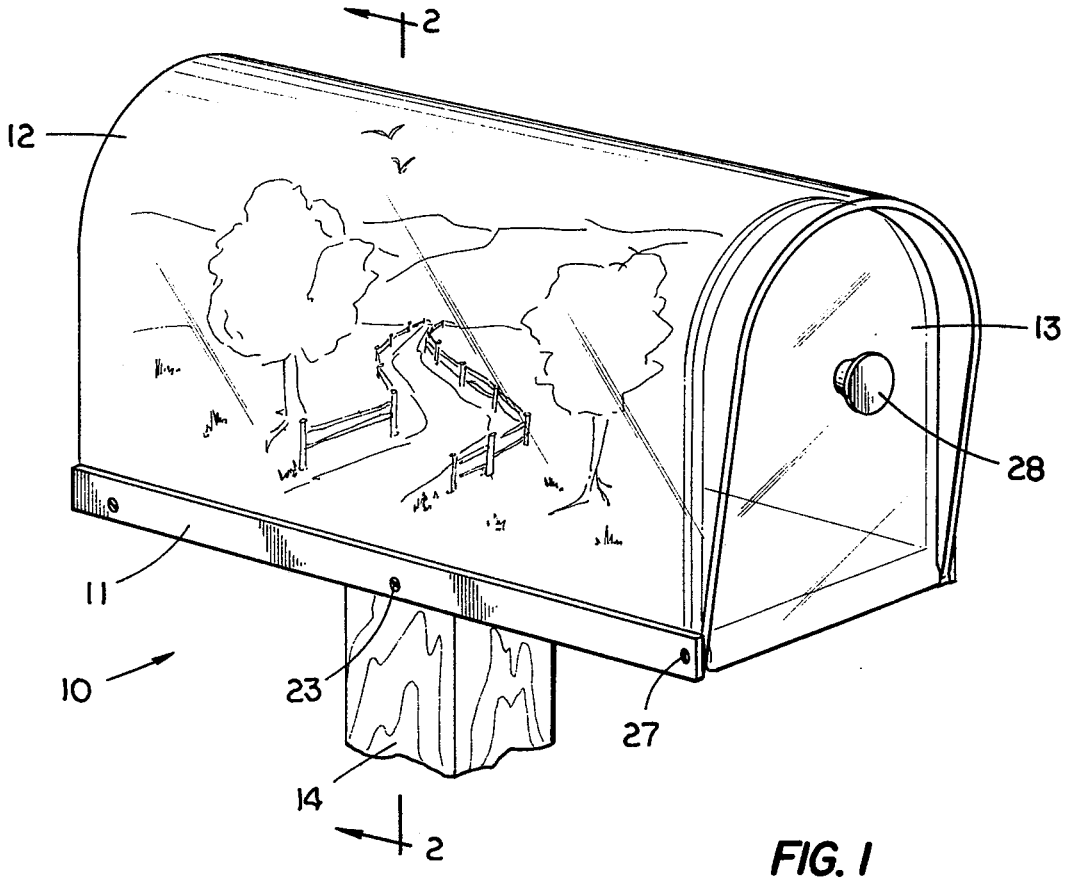
FIG. 1 is a perspective view of a mailbox constructed in accordance with the present invention.
Figure 2:
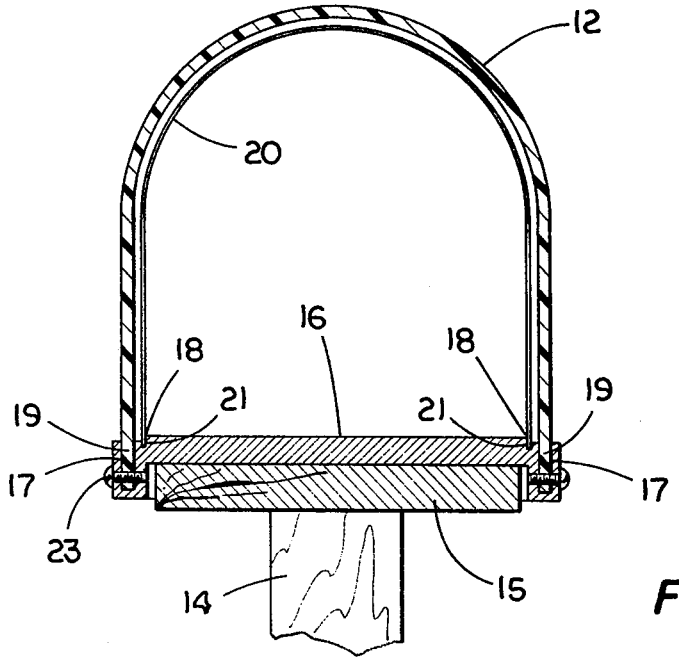
FIG. 2 is a cross-sectional view of the mailbox of FIG. 1, taken along line 2—2 in FIG. 1.
Figure 3:
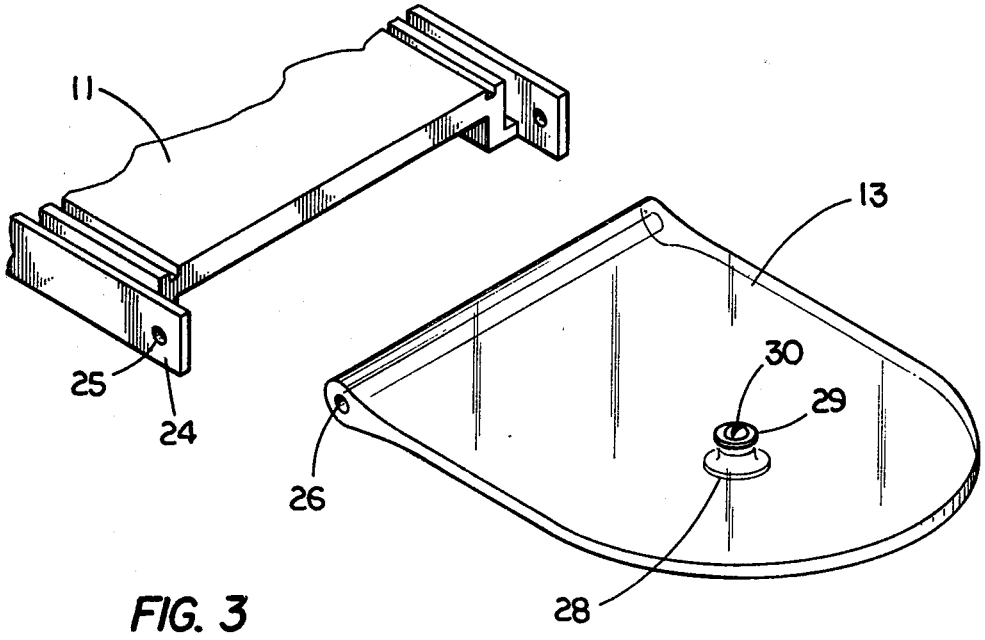
FIG. 3 is a partially-broken perspective view of a preferred embodiment of a base and door useful in the present invention, and particularly showing the manner of connection therebetween.
Figure 4:
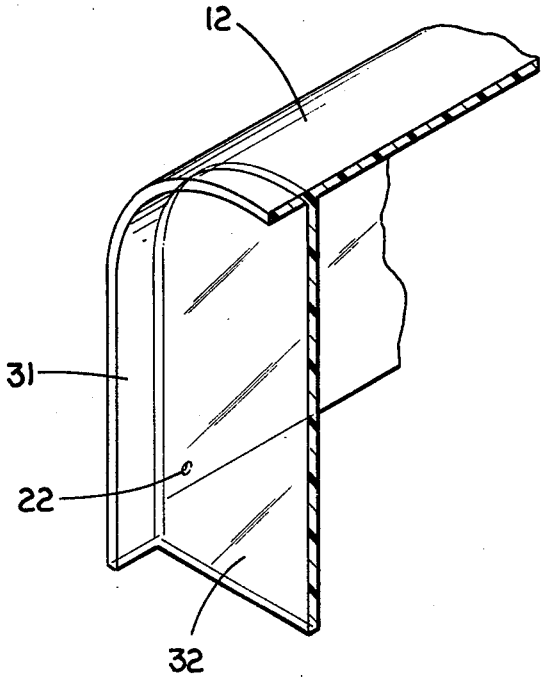
FIG. 4 is a partially-broken, cross-sectional perspective view of a preferred embodiment of a transparent cover useful in accordance with the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring in particular to the drawings, there is shown a mailbox 10 constructed in accordance with the present invention. Mailbox 10 includes a base 11 and a transparent cover 12 mounted thereon. Mailbox 10 further includes a door 13 mounted to the base. Mailbox 10 is mounted to a post 14 in conventional fashion, such as by securement of the base 11 to a mount board 15 which is in turn secured to the post 14.

Mailbox 10 is provided with means for releasably holding a picture 20 adjacent the transparent cover 12 whereby the picture is viewable from outside the mailbox. For the purposes herein, the term "picture" is defined as including a material positionable within the mailbox adjacent the cover and which material may include on its outer, viewable side either lettering, scenes or other depictions, various other informative or illustrative matter, or simply nothing at all. Of course, it is a particular feature of the present invention that the picture is provided as a means for displaying desired material, either in the form of a name or address and/or an illustration such as a logo or a depiction of scenery. The picture is readily replaced and may therefore be changed to indicate new names or different scenery as desired.

Base 11 includes an upper face 16 and has two sides. Upper face 16 of base 11 defines a first, outer pair of channels 17. One of said outer pair of channels extends along one side of the base and the other of said outer pair of channels extends along the other side of the base. Upper face 16 of base 11 further defines a second, inner pair of channels 18. One of said inner pair of channels extends along one side of the base inside of the one of said outer pair of channels located along that side. The other of said inner pair of channels extends along the other side of the base inside of the one of said outer pair of channels located along that side. Cover 12 includes opposed edges 19 which are received in the outer pair of channels 17, respectively. Picture 20 includes opposed edges 21 which are received in the inner pair of channels 18, respectively.

Cover 12 includes apertures 22 which are aligned with apertures in the base and which receive screws 23 therein to secure the cover to the base. In addition, base 11 includes forwardly extending legs 24 which define apertures 25. Door 13 includes a hole 26 and a bolt 27 extends through the apertures 25 and hole 26 to hingedly secure the door to the base. A knob 28 is secured by washer 29 and bolt 30 to the door to facilitate opening and closing of the door. In addition, the back end of the cover 12 includes an overhang 31 and a back wall 32.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A mailbox which comprises:

a base, said base including an upper face and having two sides and two ends, the upper face defining an inner and outer pair of channels extending along the two sides of said base, respectively;

a transparent cover having a pair of longitudinal opposed side edges received within the outer channels and mounted to said base;

means for releasably holding a picture adjacent said cover whereby the picture is viewable from outside the mailbox, said holding means including the inner pair of channels of said base; and a picture releasably held adjacent said cover, said picture having a pair of opposed edges received within the inner pair of channels, respectively.

2. The mailbox of claim 1 and which further includes a door and means for hingedly mounting said door to said base, said door having open and closed positions.

3. The mailbox of claim 2 and which further includes latch means for securing said door in the closed position.

* * * * *